US009060218B2

(12) United States Patent
Itou

(10) Patent No.: US 9,060,218 B2
(45) Date of Patent: Jun. 16, 2015

(54) FAILURE DETECTION DEVICE FOR VEHICLE SPEAKER

(75) Inventor: Akito Itou, Kariya (JP)

(73) Assignee: DENSO CORPORATION, Kariya (JP)

( * ) Notice: Subject to any disclaimer, the term of this patent is extended or adjusted under 35 U.S.C. 154(b) by 392 days.

(21) Appl. No.: 13/616,115

(22) Filed: Sep. 14, 2012

(65) Prior Publication Data

US 2013/0070933 A1 Mar. 21, 2013

(30) Foreign Application Priority Data

Sep. 17, 2011 (JP) ..... 2011-203888

(51) Int. Cl.
*H04R 29/00* (2006.01)
*H04R 3/00* (2006.01)

(52) U.S. Cl.
CPC ..... *H04R 3/007* (2013.01); *H04R 29/001* (2013.01); *H04R 2499/13* (2013.01)

(58) Field of Classification Search
None
See application file for complete search history.

(56) References Cited

U.S. PATENT DOCUMENTS

| | | | | | |
|---|---|---|---|---|---|
| 3,849,772 | A | * | 11/1974 | Burnett | 340/635 |
| 3,855,415 | A | * | 12/1974 | Fox et al. | 381/59 |
| 3,989,908 | A | * | 11/1976 | Budrys et al. | 381/59 |
| 4,100,380 | A | * | 7/1978 | Gosswiller | 381/58 |
| 4,110,571 | A | * | 8/1978 | Hills | 381/59 |
| 4,752,959 | A | * | 6/1988 | Matsumoto | 381/59 |
| 5,291,183 | A | * | 3/1994 | Chiang | 340/692 |
| 5,345,510 | A | * | 9/1994 | Singhi et al. | 381/77 |
| 6,370,252 | B1 | * | 4/2002 | Lunter | 381/58 |

FOREIGN PATENT DOCUMENTS

| | | |
|---|---|---|
| JP | 63-90996 | 4/1988 |
| JP | 4-447 | 1/1992 |
| JP | 7-9519 | 3/1995 |
| JP | 2507711 | 5/1996 |
| JP | 2002-23761 | 1/2002 |
| JP | 2003-274491 | 9/2003 |
| JP | 2007-37024 | 2/2007 |
| JP | 2011-70561 | 4/2011 |
| JP | 2011-109616 | 6/2011 |

OTHER PUBLICATIONS

U.S. Appl. No. 13/615,959 of Nyu et al., filed Sep. 14, 2012.
Office Action (2 pages), dated Sep. 3, 2013, issued in corresponding Japanese Application No. 2011-203888 and English translation (2 pages).

* cited by examiner

*Primary Examiner* — Brenda Bernardi
(74) *Attorney, Agent, or Firm* — Nixon & Vanderhye P.C.

(57) ABSTRACT

A failure detection device for a vehicle speaker includes a signal generator, an amplifier, a coupling capacitor, a detection circuit, and a determination section. The signal generator generates a sound signal corresponding to a sound outputted from the speaker. The amplifier amplifies the sound signal generated by the signal generator. The coupling capacitor supplies the sound signal amplified by the amplifier to the speaker. The detection circuit directly or indirectly detects a terminal voltage on a terminal of the speaker. The determination section determines whether an open-circuit occurs in the speaker based on a phase difference between a phase of the sound signal and a phase of the terminal voltage. The terminal of the speaker is coupled to the coupling capacitor.

12 Claims, 15 Drawing Sheets

FAILURE DETECTION DEVICE FOR VEHICLE SPEAKER

CROSS REFERENCE TO RELATED APPLICATION

This application is based on Japanese Patent Application No. 2011-203888 filed on Sep. 17, 2011, the disclosure of which is incorporated herein by reference.

TECHNICAL FIELD

The present disclosure generally relates to failure detection devices for a vehicle speaker and in particular relates to a failure detection device for a vehicle speaker that outputs an operation notification sound for notifying a person that a vehicle is in an operating state.

BACKGROUND

JP-2002-23761A discloses a drive circuit connected to a sound generating body and having an error determination circuit for detecting an open-circuit in the sound generating body. The error determination circuit measures a current and a voltage of a magnetic coil of the sound generating body.

JP-2003-274491A discloses an open-circuit detection device for detecting an open-circuit in a speaker. The open-circuit detection device includes an equivalent circuit having equivalent impedance to the speaker circuit and detects the open-circuit by comparing an impedance of the equivalent circuit with an impedance of the speaker circuit.

JP-2007-37024A discloses a speaker line testing device for detecting an open-circuit and a short-circuit in a speaker circuit by measuring an impedance of the speaker circuit.

JP-2011-70561A discloses an alarm device including a switch. The switch connects a circuit, which supplies a detection voltage used for open-circuit detection in a piezoelectric sound generating body, to the sound generating body, only when the open-circuit detection is performed.

The error determination circuit disclosed in JP-2002-23761A includes a current transformer and a voltage transformer on a line connected to the sound generating body. Therefore, it is difficult to reduce the number of parts, the size, and the cost of the error determination circuit.

The open-circuit detection device disclosed in JP-2003-274491A includes the equivalent circuit and a switch circuit. Therefore, it is difficult to reduce the number of parts, the size, and the cost of the open-circuit detection device. Further, the open-circuit detection device cannot detect a failure such as an open-circuit during normal operation.

The testing device disclosed in JP-2007-37024A includes a detection circuit for detecting a current in a speaker line. Therefore, it is difficult to reduce the number of parts, the size, and the cost of the testing device.

In the alarm device disclosed in JP-2011-70561A, the detection voltage is supplied only when the detection is performed. Therefore, the alarm device cannot detect a failure such as an open-circuit during normal operation.

SUMMARY

In view of the above, it is an object of the present disclosure to provide a vehicle speaker failure detection device having a small number of parts and configured to perform failure detection during normal operation.

According to an aspect of the present disclosure, a failure detection device for a vehicle speaker includes a signal generator, an amplifier, a coupling capacitor, a detection circuit, and a determination section. The signal generator generates a sound signal corresponding to a sound outputted from the speaker. The amplifier amplifies the sound signal generated by the signal generator. The coupling capacitor supplies the sound signal amplified by the amplifier to the speaker. The detection circuit directly or indirectly detects a terminal voltage on a terminal of the speaker. The determination section determines whether an open-circuit occurs in the speaker based on a phase difference between a phase of the sound signal and a phase of the terminal voltage. The terminal of the speaker is coupled to the coupling capacitor.

BRIEF DESCRIPTION OF THE DRAWINGS

The above and other objects, features and advantages of the present disclosure will become more apparent from the following detailed description made with reference to the accompanying drawings. In the drawings:

FIGS. 3A, 38, and 3C are diagrams illustrating the waveforms of the voltages of the portions of the sound generator of FIG. 1 observed during an open-circuit period where an open-circuit occurs in the speaker;

DETAILED DESCRIPTION

First Embodiment

Figure 1:
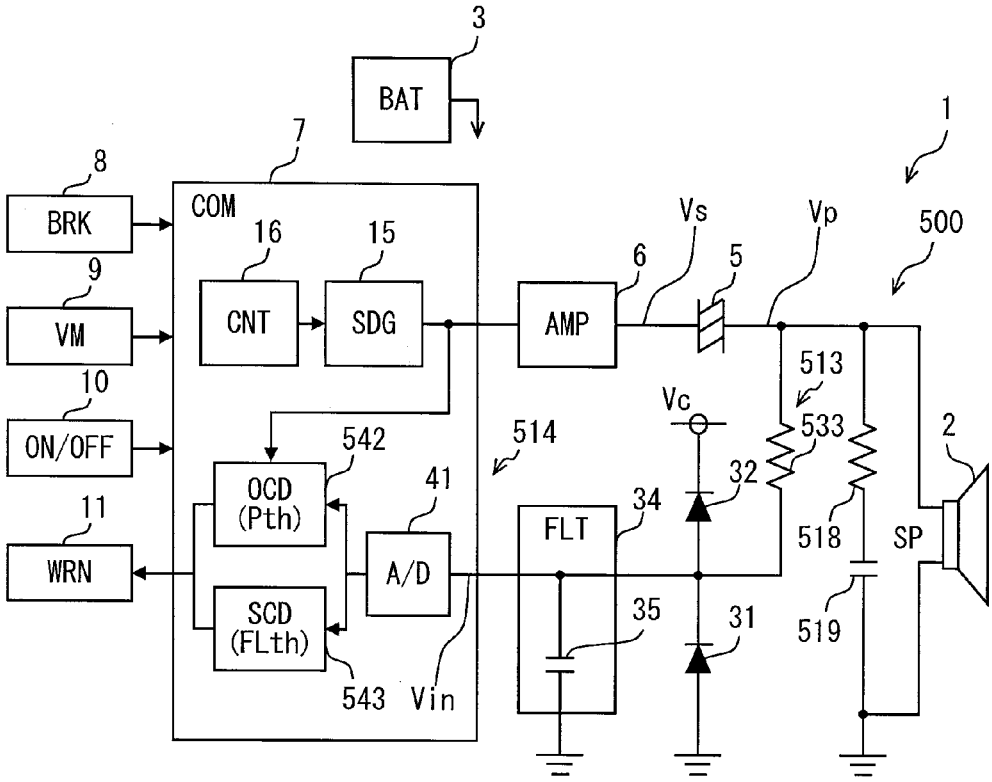
FIG. 1 is a block diagram of an operation notification sound generator including a failure detection device according to a first embodiment of the present disclosure.

FIG. 1 is a block diagram of an operation notification sound generator 1 including a failure detection device 500 according to a first embodiment of the present disclosure. The sound generator 1 is mounted on a vehicle and generates a notification sound designed to inform a person inside and outside the vehicle that the vehicle is in an operating state. The operating state can include a first operating state where the vehicle is running and a second operating state where the vehicle is ready to run. For example, when the vehicle is in the first operating state, the notification sound can inform a pedestrian of the presence of the vehicle, and when the vehicle is in the second operating state, the notification sound can inform an occupant of the vehicle that an engine of the vehicle is staring. Unlike a conventional horn device, the sound generator 1 continuously outputs the notification sound while the vehicle is running at a speed lower than a predetermined threshold. In addition, the sound generator 1 can continuously output the notification sound when the vehicle is temporarily stopped at a traffic light or the like.

For example, the sound generator 1 can be mounted on an electric vehicle, a hybrid electric vehicle, or a low-noise vehicle. The electric vehicle uses an electric motor to run. The hybrid electric vehicle uses both an electric motor and an internal-combustion engine to run. The low-noise vehicle uses an internal-combustion engine with a noise reduction function to run. If the sound generator 1 is mounted on the hybrid electric vehicle, the sound generator 1 can output the notification sound only when the hybrid electric vehicle is running by using only the electric motor.

The sound generator 1 has a speaker 2 (denoted as "SP" in the drawings) with a speaker circuit. The speaker 2 is mounted on the vehicle. The speaker 2 is a dynamic speaker with a voice coil. That is, the speaker 2 is an inductive device. A negative terminal of the speaker 2 is connected to a ground potential. A positive terminal of the speaker 4 is supplied with an alternating-current (AC) voltage for generating the notification sound. The sound generator 1 is provided with a power source 3 (denoted as "BAT" in the drawings). The power source 3 is a battery mounted on the vehicle. The power source 3 serves as a power source for the sound generator 1.

The sound generator 1 includes a coupling capacitor 5 and a power amplifier 6 (denoted as "AMP" in the drawings). The power amplifier 6 amplifies a sound signal for the notification sound. The coupling capacitor 5 passes a predetermined AC component of an output of the power amplifier 6 to generate the notification sound. An output of the coupling capacitor 5 is inputted to the speaker 2.

The sound generator 1 includes a controller 7 (denoted as "COM" in the drawings). The controller 7 is an electronic control unit including a microcomputer and a memory device readable by the microcomputer. The memory device stores programs. The microcomputer executes the programs stored in the memory device so that the controller 7 can perform predetermined functions described in the specification. For example, the controller 7 generates the sound signal and outputs the sound signal to the power amplifier 6. The controller 7 can start and stop generating the notification sound.

The sound generator 1 is provided with a brake sensor 8 (denoted as "BRK" in the drawings) for detecting a condition of a brake of the vehicle. A brake signal indicative of the detected brake condition is outputted from the brake sensor 8 and inputted to the controller 7. The sound generator 1 is provided with a speed sensor 9 (denoted as "VM" in the drawings) for detecting a running speed of the vehicle. A speed signal indicative of the detected running speed is outputted from the speed sensor 9 and inputted to the controller 7. The controller 7 generates the notification sound based on the speed signal. Specially, the controller 7 generates the notification sound when the speed of the vehicle is in a predetermined range. For example, the controller 7 can generate the notification sound when the speed of the vehicle falls within a low speed range from 0 km/h to 20 km/h. The sound generator 1 is provided with a selector 10 (denoted as "ON/OFF" in the drawings) for outputting a selection signal for allowing or preventing the generation of the sound signal. The selection signal is inputted from the selector 10 to the controller 7. For example, the selector 10 can be a switch operable by a driver of the vehicle or another electronic control unit mounted on the vehicle. For example, the selector 10 can prevent the generation of the sound signal when the vehicle is parked, and can allow the generation of the sound signal when the vehicle is in the operating state. The driver can stop the generation of the notification sound at any time by operating the selector 10 so that the generation of the sound signal can be prevented.

The sound generator 1 is provided with a warning device 11 (denoted as "WRN" in the drawings) which is activated upon detection of a failure in the speaker 2. The warning device 11 aurally or visually informs a user of the vehicle that a failure occurs in the speaker 2. For example, the warning device 11 can be a warning lamp, a warning buzzer, or a display device that displays a warning image on a display screen mounted on the vehicle.

The controller 7 includes a sound signal generator 15 (denoted as "SDG" in the drawings) for generating the sound signal according to the speed of the vehicle. Specifically, the sound signal generator 15 generates the sound signal by synthesizing sound data stored in a memory device that is located inside or outside the controller 7. The sound signal generated by the sound signal generator 15 is inputted to the power amplifier 6. The controller 7 includes a control section 16 (denoted as "CNT" in the drawings) for controlling the sound signal generator 15. The control section 16 controls the sound signal generator 15 in accordance with the brake signal from the brake sensor 8, the speed signal from the speed sensor 9, and the selection signal from the selector 10. The control section 16 allows the controller 7 to start and stop generating the notification sound.

The sound generator 1 includes a failure detection device 500 for detecting a failure in the speaker 2. Specifically, the failure detection device 500 detects an open-circuit and/or a short-circuit in the speaker 2. The open-circuit in the speaker 2 can include a break in a wire of an internal circuit of the speaker 2 and a break in a wire of an energization circuit for energizing the speaker 2. Thus, the failure detection device 500 detects the open-circuit in the speaker 2 including the speaker circuit. The short-circuit in the speaker 2 can include a short-circuit in the wire of the internal circuit of the speaker 2, a short-circuit of the terminal of the speaker 2 to the ground potential, and a short-circuit of the energization circuit for energizing the speaker 2 to the ground potential. Thus, the failure detection device 500 detects the short-circuit in the speaker 2 including the speaker circuit.

The sound generator 1 includes a resistor 518 and a capacitor 519. The resistor 518 and the capacitor 519 are connected in series to form a filter circuit which is connected in parallel to the speaker 2. That is, the speaker circuit including the speaker 2 has both an inductive component such as the voice coil of the speaker 2 and a capacitive component such as the capacitor 519 of the filter circuit.

The sound generator 1 includes a detection circuit 513 for detecting a voltage signal applied to the speaker 2. The detection circuit 513 directly or indirectly detects a voltage appearing at the terminal of the speaker 2 coupled to the coupling capacitor 5. According to the first embodiment, the speaker circuit includes the resistor 518 and the capacitor 519, and the detection circuit 513 detects a voltage Vp on the speaker circuit of the speaker 2.

The detection circuit 513 also serves as a converter for converting the voltage Vp into a voltage acceptable by the controller 7. Specifically, the detection circuit 513 converts the voltage Vp into a voltage Vin and outputs the voltage Vin to the controller 7. Thus, the voltage Vp corresponds to the voltage Vin. The voltages Vp and Vin are measured to detect the open-circuit and/or the short-circuit in the speaker 2.

The detection circuit 513 also serves as a protector for protecting the controller 7 from an AC signal. The detection circuit 513 includes a diode 31. An anode of the diode 31 is connected to the ground potential, and a cathode of the diode 71 is connected to an output terminal of the detection circuit 513. That is, the diode 31 is connected in a reverse bias direction between the ground potential and the output terminal of the detection circuit 513. Thus, the diode 31 can serve as a protection diode for blocking a negative voltage. When the sound signal is supplied to the speaker 2, the voltage Vp changes in positive and negative directions. The diode 31 removes the negative voltage to prevent the negative voltage from being inputted to the controller 7. Thus, an input port of the controller 7 can be protected.

The detection circuit 513 further includes a diode 32. An anode of the diode 32 is connected to the output terminal of the detection circuit 513, and a cathode of the diode 32 is connected to a power source Vc. That is, the diode 32 is connected in a reverse bias direction between the output terminal of the detection circuit 513 and the power source Vc. The power source Vc provides a stabilized power supply voltage for an electronic circuit. The power source Vc and the diode 32 form a pull-up circuit for limiting the voltage Vin up to the power supply voltage of the power source Vc. Thus, even when the voltage Vp is greater than the power supply voltage of the power source Vc, the voltage Vin outputted from the detection circuit 513 can be inputted to the controller 7.

The detection circuit 513 includes a resistor 533 that serves as a current limiter. A first end of the resistor 533 is connected between the coupling capacitor 5 and the speaker 2. A second end of the resistor 533 is connected between the diodes 31 and 32. The diodes 31 and 32 are connected in series. The resistor 533 and the series circuit of the diodes 31 and 32 form a protection circuit for limiting the voltage Vin.

Further, the detection circuit 513 includes a filter circuit 34 (denoted as "FLT" in the drawings) including a low-pass filter that passes low frequency components but blocks high frequency components. The filter circuit 34 can include a capacitor 35. The voltage Vin outputted from the detection circuit 513 is inputted to the controller 7.

The controller 7 provides a determination section 514. The controller 7 has the input port for receiving the voltage Vin detected by the detection circuit 513. The input port of the controller 7 is an AD conversion port. The controller 7 includes an analog-to-digital (A/D) converter 41 (denoted as "A/D" in the drawings) for converting the voltage Vin into digital data. According to the first embodiment, the determination section 514 is implemented by software. i.e., the programs performed by the controller 7. The determination section 514 detects the open-circuit in the speaker 2 based on a phase difference between the voltage Vin and the sound signal.

Specifically, the determination section 514 includes an open-circuit detector 542 (denoted as "OCD" in the drawings) for detecting the open-circuit in the speaker 2. The open-circuit detector 542 determines whether the open-circuit occurs in the speaker 2 by comparing a phase of the voltage Vin indicated by an output of the A/D converter 41 with a phase of a voltage Vs of the sound signal indicated by an output of the sound signal generator 15. A phase of the voltage Vp depends mainly on the inductance of the voice coil of the speaker 2. When the open-circuit or the short-circuit occurs in the speaker 2, the inductance of the speaker 2 changes so that a signal phase can change. For example, when neither the open-circuit nor the short-circuit occurs in the speaker 2, the voltage Vp is delayed in phase from the voltage Vs corresponding to the sound signal. In contrast, when the open-circuit or the short-circuit occurs in the speaker 2, the inductance decreases or becomes zero so that the delay of the phase of the voltage Vp with respect to the phase of the voltage Vs can be reduced. Assuming that the open-circuit occurs in the speaker 2, the voltage Vp becomes almost in phase with the voltage Vs.

When the phase of the voltage Vin, i.e., the phase of the voltage Vp achieves a predetermined relationship with respect to the phase of the voltage Vs, the open-circuit detector 542 determines that the open-circuit occurs in the speaker 2. Specifically, when the phase difference between the voltage Vs and the voltage Vp falls outside a predetermined threshold range Pth, the open-circuit detector 542 determines that the open-circuit occurs in the speaker 2. The threshold range Pth is set so that the open-circuit detector 542 can detect that the inductive component of the speaker circuit becomes almost zero. When the open-circuit detector 542 determines that the open-circuit occurs in the speaker 2, the open-circuit detector 542 outputs a first activation signal for activating the warning device 11. In response to the first activation signal, the warning device 11 is activated and outputs a first &arm indicating that the open-circuit occurs in the speaker 2.

The determination section 514 further includes a short-circuit detector 543 (denoted as "SCD" in the drawings) for detecting the short-circuit in the speaker 2. The short-circuit detector 543 determines whether the short-circuit occurs in the speaker 2 by comparing a change Vflc in the voltage Vp, the voltage Vin, indicated by the output of the A/D converter 41, with a predetermined threshold change value FLth. The threshold change value FLth is set so that the short-circuit detector 543 can detect that the short-circuit occurs in the speaker 2. Specifically, the threshold change value FLth is set so that the short-circuit detector 543 can detect that the voltage Vp remains almost unchanged. When the change Vflc in the voltage Vp during a predetermined period Tprd decreases below the threshold change value FLth, the short-circuit detector 543 determines that the short-circuit occurs in the speaker 2. When the short-circuit detector 543 determines that the short-circuit occurs in the speaker 2, the short-circuit detector 543 outputs a second activation signal for activating the warning device 11. In response to the second activation signal, the warning device 11 is activated and outputs a second alarm indicating that the short-circuit occurs in the speaker 2.

Figure 2A:
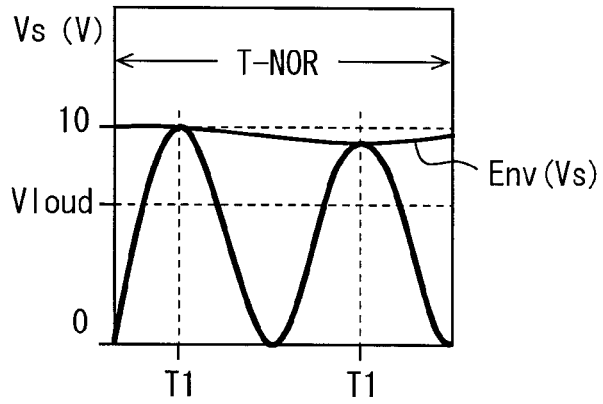
FIGS. 2A, 2B, and 2C are diagrams illustrating waveforms of voltages of portions of the sound generator of FIG. 1 observed during a normal operating period where a speaker operates normally.
Figure 2B:
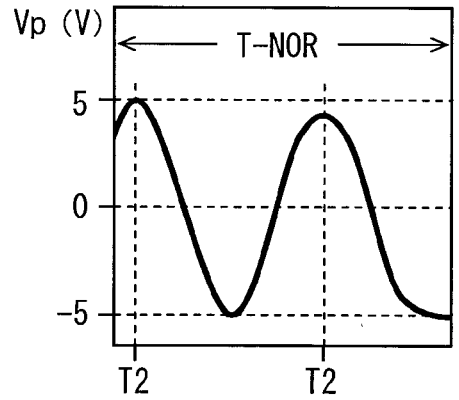
Figure 2C:
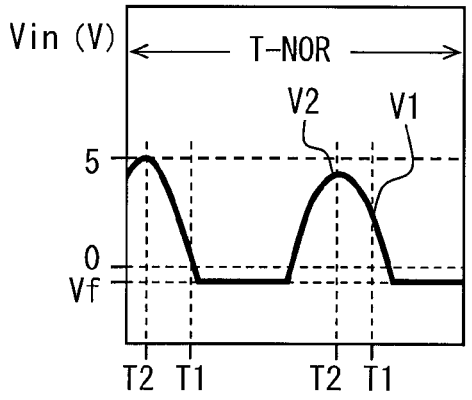
Figure 3A:
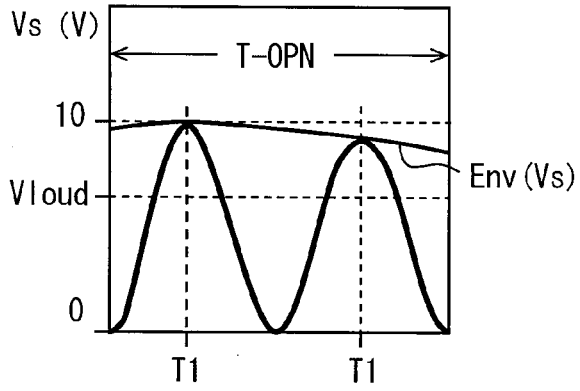
Figure 3B:
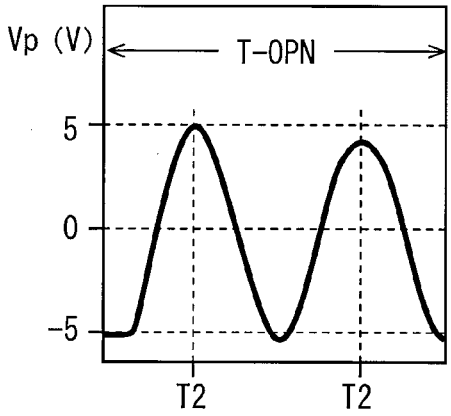
Figure 3C:
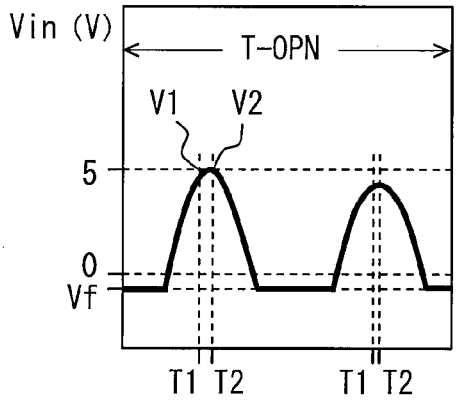

FIGS. 2A, 2B, and 2C are diagrams illustrating waveforms of voltages of portions or the sound generator 1 observed during a normal operating period T-NOR where the speaker 2 operates normally. That is, the waveforms shown in FIGS. 2A, 2B, and 2C are observed when neither the open-circuit nor the short-circuit occurs in the speaker 2. FIGS. 3A, 3B, and 3C are diagrams illustrating the waveforms of the voltages of the portions of the sound generator 1 observed during an open-circuit period T-OPN where the open-circuit occurs in the speaker 2. It is noted that the waveforms shown in these drawings are observed by using an oscilloscope and simplified for the purpose of explanation.

Specifically, FIGS. 2A and 3A illustrate the waveform of the voltage Vs observed when the notification sound is generated. During the operation of the sound signal generator 15, i.e., during an ON-period of the sound signal generator 15, an AC signal used to generate the notification sound appears as the voltage Vs. An envelope Env(Vs) of the waveform of the voltage Vs indicates a volume level (i.e., magnitude) of the notification sound. A maximum value Vs (peak) of the voltage Vs appears at a time T1.

FIGS. 2B and 3B illustrate the waveform of the voltage Vp observed when the notification sound is generated. The phase of the voltage Vp changes depending on the inductive component, the resistive component, and the capacitive component of the circuit including the speaker 2 in addition to the capacitive component of the coupling capacitor 5 and a driving frequency of the speaker 2. For example, when the coupling capacitor 5 has a capacitance of 220 μF, the driving frequency is about 220 Hz, and the speaker 2 has an inductance of 350 μF and an impedance of 8Ω, the voltage Vp is delayed in phase from the voltage Vs during the normal operating period T-NOR. This delay of the phase of the voltage Vp depends on the inductive component, the resistive component, and the capacitive component of the circuit including the speaker 2 in addition to the capacitive component of the coupling capacitor 5 and the driving frequency. Since the sound generator 1 continuously generates an almost uniform notification sound, the speaker 2 is driven by a signal with an almost uniform frequency. During the open-circuit period T-OPN, the voltage Vp is almost in phase with the voltage Vs. A maximum value Vp (peak) of the voltage Vp appears at a time T2.

FIGS. 2C and 3C illustrate the waveform of the voltage Vin observed when the notification sound is generated. During the operation of the sound signal generator 15, a half-wave rectified voltage generated by the diode 31 appears as the voltage Vin. A symbol "Vf" in FIGS. 2C and 2C represents a forward voltage drop of the diode 31. The voltage Vin has a value V1 at the time T1 and has a value V2 at the time T2.

During the normal operating period T-NOR, since the voltage Vp is delayed in phase from the voltage Vs, the value V2 is greater than the value V1 (i.e., V2>V1). Further, during the normal operating period T-NOR, a voltage difference V2−V1, which is calculated by subtracting the value V1 from the value V2, falls within a predetermined threshold range. For example, during the normal operating period T-NOR, the voltage difference V2−V1 ranges from a lower threshold voltage Vth1 to an upper threshold voltage Vth2. During the open circuit period T-OPN, the voltage Vp is almost in phase with or slightly delayed in phase from the voltage Vs. Therefore, the values V1 and V2 are almost identical to each other. As a result, during the open-circuit period T-OPN, the voltage difference V2−V1 falls outside the threshold range. For example, during the open-circuit period T-OPN, the voltage difference V2−V1 decreases below the lower threshold voltage Vth1. If the voltage difference V2−V1 increases above the upper threshold voltage Vth2, it can be estimated that some failures occur in the speaker 2. In this way, whether or not the phase difference between the voltage Vp and the voltage Vs is less than the predetermined threshold Pth can be determined based on the lower threshold voltage Vth1. Whether or not the phase difference between the voltage Vp and the voltage Vs is abnormally increased can be determined based on the upper threshold voltage Vth2.

Figure 4:
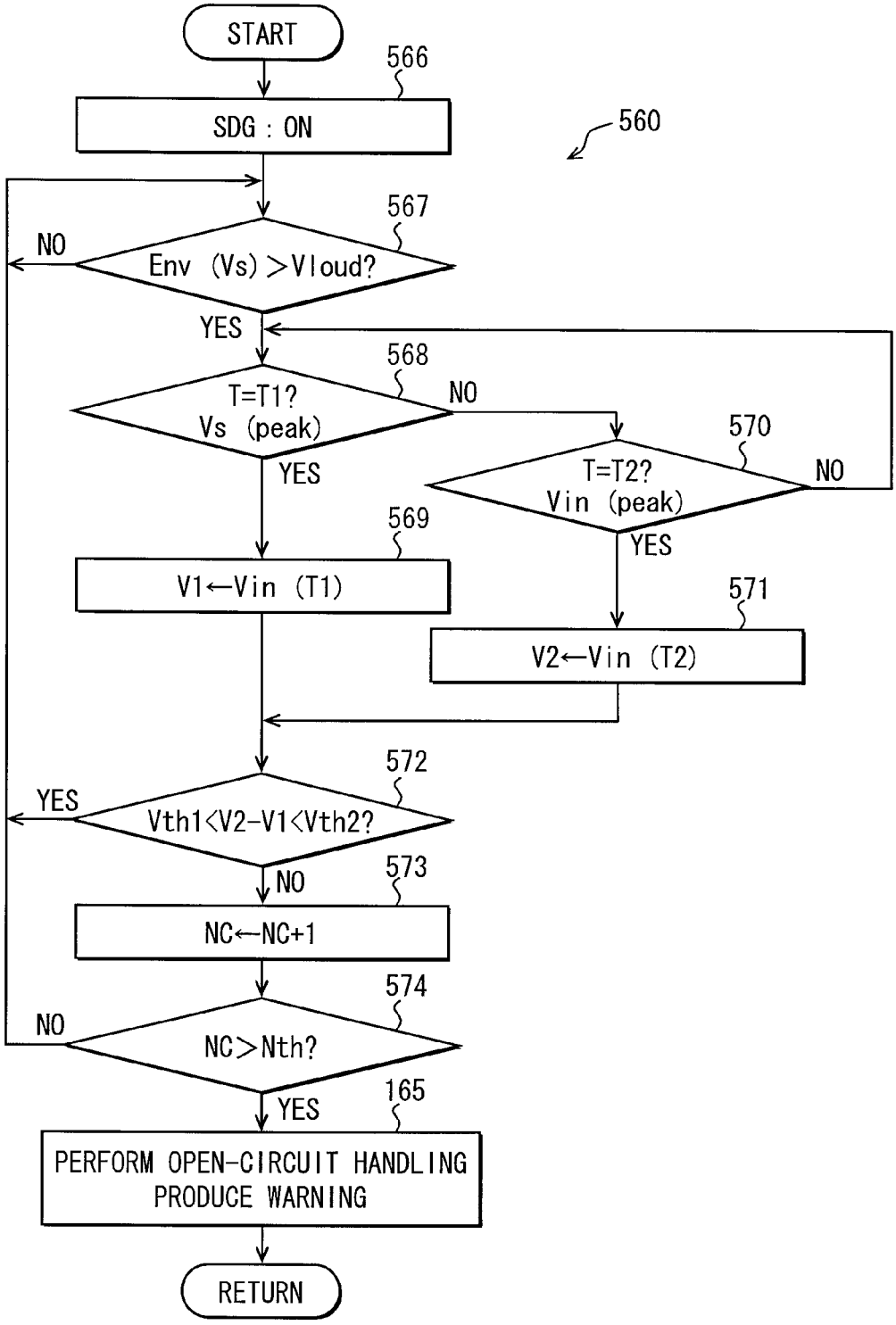
FIG. 4 is a flow chart of an open-circuit determination process performed in the sound generator of FIG. 1.

FIG. 4 is a flow chart of an open-circuit determination process 560 for implementing the open-circuit detector 542. The open-circuit determination process 560 starts at step 566, where it is made sure that the sound signal for the notification sound is outputted from the sound signal generator 15. That is, at step 566, it is made sure that AC signal (i.e., AC power) for allowing the speaker 2 to output the notification sound is supplied to the speaker 2.

Then, the open-circuit determination process 560 proceeds to step 567, were it is determined whether the voltage Vs corresponding to the sound signal exceeds a predetermined volume level. In the controller 7, the voltage Vs is supplied from the sound signal generator 15 to the open-circuit detector 542. Specifically, at step 567, it is determined whether the envelope Env(Vs) of the waveform of the voltage Vs exceeds a predetermined threshold level Vloud. Step 567 is repeated until it is determined that the envelope Env(Vs) exceeds the threshold level Vloud. If it is determined that the envelope Env(Vs) exceeds the threshold level Vloud corresponding to YES at step 567, the open-circuit determination process 560 proceeds to step 568. The step 567 provides a volume determination section for determining that the open-circuit occurs in the speaker 2 when the envelope Env(Vs) exceeds the threshold level Vloud. Thus, the phase difference can be surely detected.

At step 568, it is determined whether a present time T is a predetermined first measurement time T1. According to the first embodiment, the first measurement time T1 is a time when the voltage Vs reaches the maximum value Vs (peak). That is, at step 568, it is determined whether the voltage Vs reaches the maximum value Vs (peak). If the voltage Vs reaches the maximum value Vs (peak) corresponding to YES at step 568, the open circuit determination process 560 proceeds to step 569, where a voltage Vin(T1), which is the voltage Vin at the first measurement time T1, is stored as the voltage value V1. In contrast, if the voltage Vs does not reach the maximum value Vs (peak) corresponding to NO at step 568, the open-circuit determination process 560 proceeds to step 570.

At step 570, it is determined whether the present time T is a predetermined second measurement time T2. According to the first embodiment, the second measurement time T2 is a time when the voltage Vin reaches the maximum value Vin (peak). That is, at step 570, it is determined whether the voltage Vin reaches the maximum value Vin (peak). If the voltage Vin reaches the maximum value Vin (peak) corresponding to YES at step 570, the open-circuit determination process 560 proceeds to step 571, where a voltage Vin(T2), which is the voltage Vin at the second measurement time T2, is stored as the voltage value V2. In contrast, if the voltage Vin does not reach the maximum value Vin (peak) corresponding to NO at step 570, the open-circuit determination process 560 returns to step 568. The steps 568-571 provides a sample collection section for collecting the sample values V1, V2 for evaluating the phase difference between the voltage Vs and the voltage Vp.

Thus, when both step 569 and step 571 are performed, the voltage values V1 and V2 used to evaluate the phase difference can be obtained. Then, the open-circuit determination process 560 proceeds to step 572, where it is determined whether the voltage difference V2−V1 falls within the threshold range. Specifically, at step 572, it is determined whether the voltage difference V2−V1 is greater than the lower threshold voltage Vth1 and less than the upper threshold voltage Vth2. If the voltage difference V2−V1 falls within the threshold range corresponding to YES at step 572, the open-circuit determination process 560 returns to step 567. In contrast, if the voltage difference V2−V1 falls outside the threshold range corresponding to NO at step 572, it is determined that the open-circuit occurs in the speaker 2, and the open-circuit determination process 560 proceeds to step 573. For example, if the voltage difference V2−V1 is less than the lower threshold voltage Vth1 or greater than the upper threshold voltage Vth2, the open-circuit determination process 560 proceeds to step 573. The step 572 provides an open-circuit determination section for determining whether the open-circuit occurs in the speaker 2 based on the phase difference between the voltage Vs and the voltage Vp.

At step 573, a counter NC is incremented by one. The counter NC indicates the number of consecutive times it is determined at step 572 that the open-circuit occurs in the speaker 2. Then, the open-circuit determination process 560 proceeds to step 574, where it is determined whether the counter NC exceeds a predetermined threshold number Nth. If the counter NC does not exceed the threshold number Nth corresponding to NO at step 574, the open-circuit determination process 560 returns to step 567. In contrast, if the counter NC exceeds the threshold number Nth corresponding to YES at step 574, the open-circuit determination process 560 proceeds to step 165. The steps 573 and 574 provide a period determination section for determining whether condition, where the voltage difference V2−V1 falls outside the threshold range, continues for a predetermined time period. The period determination section stabilizes a subsequent open-circuit determination process by ignoring a temporary open-circuit condition.

Thus, the determination section 514 compares the phase of the voltage Vs corresponding to the sound signal with the phase of the voltage Vp detected by the detection circuit 513. Then, when the phase of the voltage Vp achieves the predetermined relationship with respect to the phase of the voltage Vs, the determination section 514 determines that the open-circuit occurs in the speaker 2. Specifically, the determination section 514 determines that the open-circuit occurs in the speaker 2, when the predetermined relationship between the phases of the voltages Vp and Vs continues for the predetermined time period.

At step 165, a predetermined open-circuit handling procedure is performed in response to the detection of the open-circuit in the speaker 2. According to the first embodiment, the open-circuit handling procedure includes a warning procedure for informing a user of the vehicle that the open-circuit occurs in the speaker 2. Specifically, at step 165, the warning device 11 is activated. In addition to or instead of the warning procedure, the open-circuit handling procedure can include a protection procedure for stopping the sound signal generator 15.

As described above, according to the open-circuit determination process 560, the determination section 514 determines whether the open-circuit occurs in the speaker 2 based on the phase difference that is indicated by the voltage Vin (i.e., V1) detected by the detection circuit 513 when the sound signal is at the phase T1 and the voltage Vin (i.e., V2) detected by the detection circuit 513 when the sound signal is at the phase T2.

Figure 5:
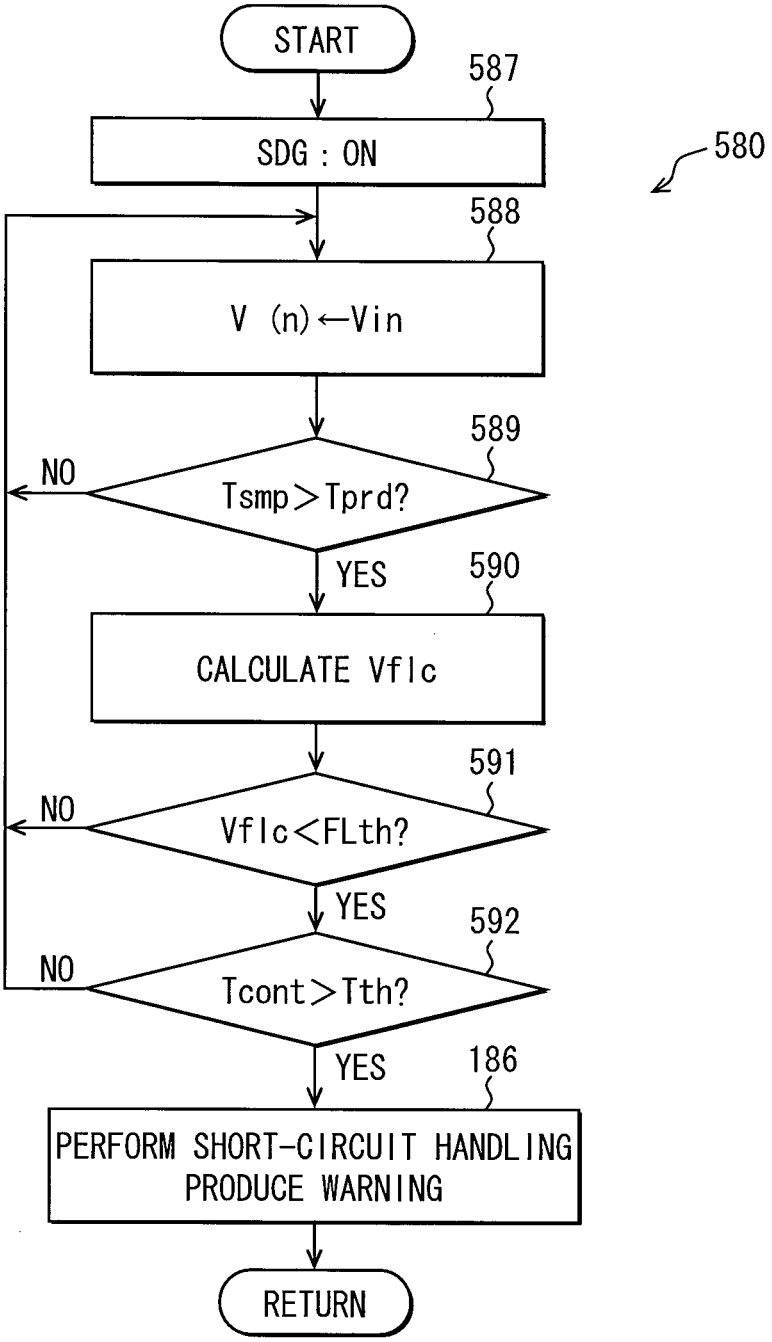
FIG. 5 is a flow chart of a short-circuit determination process performed in the sound generator of FIG. 1.

FIG. 5 is a flow chart of a short-circuit determination process 580 for implementing the short-circuit detector 543. When the voltage Vs corresponding to the sound signal is supplied to the speaker 2 under a condition where the speaker 2 operates normally, the voltage Vin changes depending on the voltage Vs. In contrast, when the voltage has Vs corresponding to the sound signal is supplied to the speaker 2 under a condition where a short-circuit occurs in the speaker 2 (e.g., in the voice coil), the voltage Vin is reduced to almost zero volt (i.e., 0V) and remains unchanged at almost zero volt. According to the first embodiment, it is determined whether the short-circuit occurs in the speaker 2 based on the change Vflc in the voltage Vin.

The short-circuit determination process 580 starts at step 587, where it is made sure that the sound signal for the notification sound is outputted from the sound signal generator 15. That is, at step 587, it is made sure that AC signal (i.e., AC power) for allowing the speaker 2 to output the notification sound is supplied to the speaker 2.

Then, the short-circuit determination process 580 proceeds to step 588, where the voltage Vin is sampled, and the sampled voltage Vin is stored as a sampling voltage V(n).

Then, the short-circuit determination process 580 proceeds to step 589, where it is determined whether a sampling period Tsmp exceeds a predetermined threshold period Tprd. If the sampling period Tsmp does not exceed the threshold period Tprd corresponding to NO at step 589, the short-circuit determination process 580 returns to step 588. Thus, step 588 is repeated during the threshold period Tprd. In contrast, if the sampling period Tsmp exceeds the threshold period Tprd corresponding to YES at step 589, the short-circuit determination process 580 proceeds to step 590. At step 590, the change Vflc is calculated from multiple sampling voltages V(n) that are sampled during the threshold period Tprd. Steps 588-590 provide a change calculation section for calculating the change Vflc in the voltage Vin.

Then, the short-circuit determination process 580 proceeds to step 591, where it is determined whether the change Vflc is less than the threshold change value FLth. If the change Vflc is not less than the threshold change value FLth corresponding to NO at step 591, it is determined that the speaker 2 operates normally, and the short-circuit determination process 580 returns to step 588. In contrast, if the change Vflc is less than the threshold change value FLth corresponding to YES at step 591, the short-circuit determination process 580 proceeds to step 592. At step 592, it is determined whether a period Tcont, during which the change Vflc remains less than the threshold change value FLth, exceeds a predetermined threshold period Tth. Step 592 stabilizes a subsequent short-circuit determination process by ignoring a temporary short-circuit condition.

If the period Tcont does not exceed the threshold period Tth corresponding to NO at step 592, the short-circuit determination process 580 returns to step 588. In contrast, if the period Tcont exceeds the threshold period Tth corresponding to YES at step 592, the short-circuit determination process 580 proceeds to step 186.

As described above, at to the short-circuit determination process 580, the determination section 514 compares the change Vflc in the voltage in detected by the detection circuit 513 with the threshold change value FLth. Then, when the change Vflc achieves the predetermined relationship with respect to the threshold change value FLth, the determination section 514 determines that the short-circuit occurs in the speaker 2. Specifically, the determination section 514 determines that the short-circuit occurs in the speaker 2, when the change Vflc becomes less than the threshold change value FLth. More specifically, the determination section 514 determines that the short-circuit occurs in the speaker 2, when the change Vflc remains less than the threshold change value FLth for the threshold period Tth.

At step 186, a predetermined short-circuit handling procedure is performed in response to the detection of the short-circuit in the speaker 2. According to the first embodiment, the short-circuit handling procedure includes a warning procedure for informing a user of the vehicle that the short-circuit occurs in the speaker 2. Specifically, at step 186 the warning device 11 is activated. In addition to or instead of the warning procedure, the short-circuit handling procedure can include a protection procedure for stopping the sound signal generator 15.

As described above, according to the first embodiment, the open-circuit in the speaker 2 can be detected based on the terminal voltage of the speaker 2. Specifically, the open-circuit in the speaker 2 can be detected based on the change in the phase of the terminal voltage of the speaker 2. In particular, since the sound generator 1 outputs a predetermined operation notification sound, the change in the phase can be stably detected. Further, the short-circuit in the speaker 2 can be detected based on the terminal voltage of the speaker 2.

Second Embodiment

Figure 6:
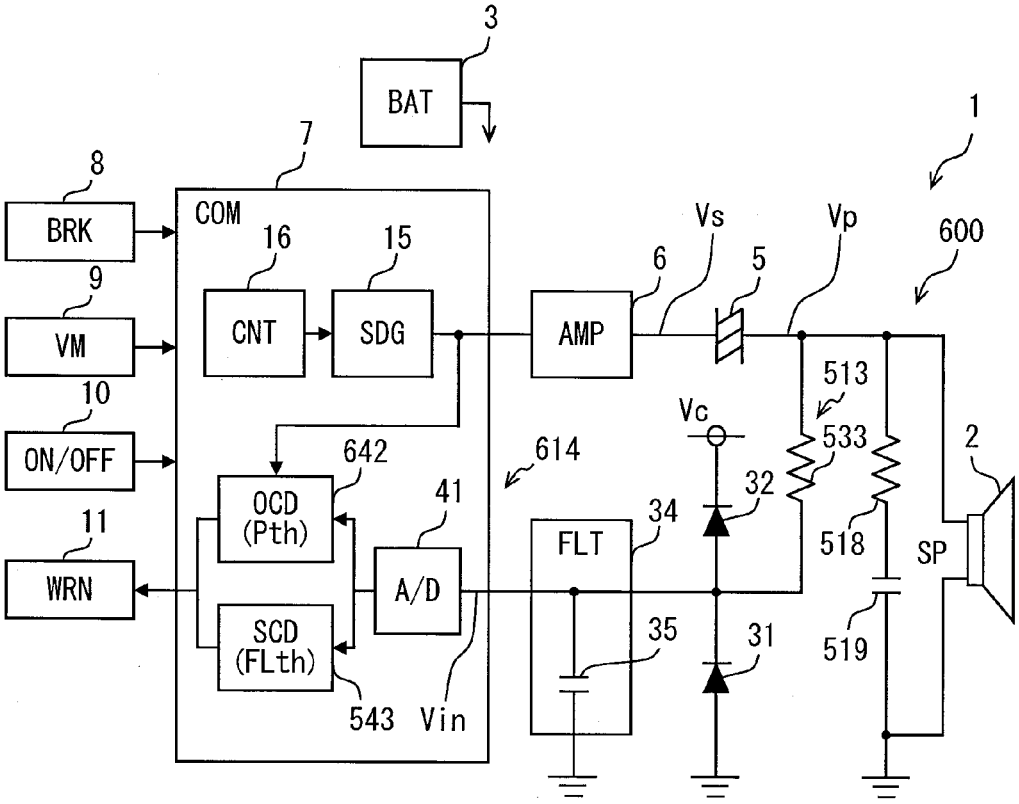
FIG. 6 is a block diagram of an operation notification sound generator including a failure detection device according to a second embodiment of the present disclosure.

FIG. 6 is a block diagram of an operation notification sound generator 1 including a failure detection device 600 according to a second embodiment of the present disclosure. A difference between the failure detection devices 500 and 600 is as follows.

In the failure detection device 500 of the first embodiment, the determination whether the phase difference between the voltages Vs and Vp achieves the predetermined relationship indicating the open-circuit n the speaker 2 is performed by observing the voltage Vin at two time points T1 and T2.

In the failure detection device 600 of the second embodiment, the determination whether the phase difference between the voltages Vs and Vp achieves the predetermined relationship indicating the open-circuit in the speaker 2 is performed based on a voltage level Vsm at a predetermined time Tsm. An open-circuit detector 642 of a determination section 614 determines whether the phase difference between the voltages Vs and Vp achieves the predetermined relationship indicating the open-circuit in the speaker 2 based on a voltage level of one of the voltages Vs and Vp observed when the other of the voltages Vs and Vp has a predetermined voltage level. According to the second embodiment, the open-circuit detector 642 uses a voltage level of the voltage Vp, i.e., the voltage Vin observed when the voltage level of the voltage Vs is −5V.

Figure 7A:
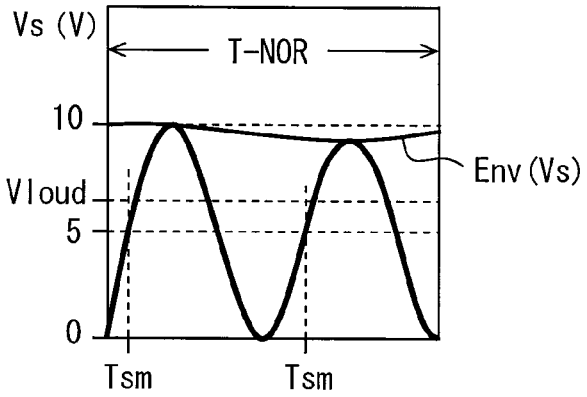
FIGS. 7A, 7B, and 7C are diagrams illustrating waveforms of voltages of portions of the sound generator of FIG. 6 observed during a normal operating period where a speaker operates normally.
Figure 7B:
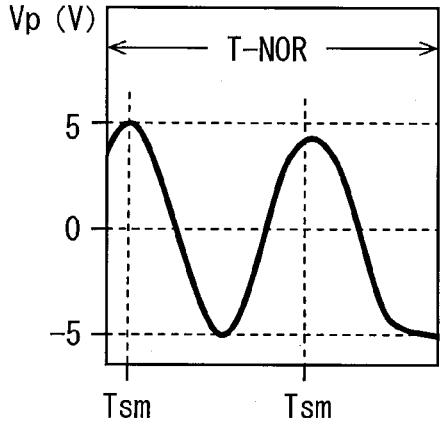
Figure 7C:
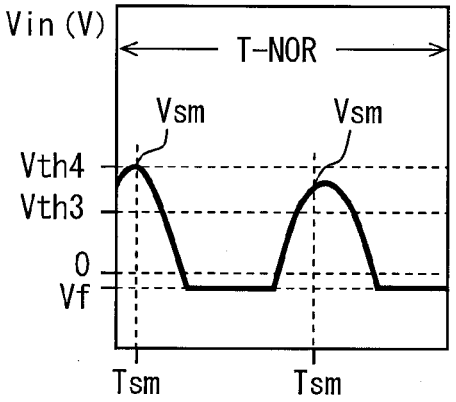
Figure 8A:
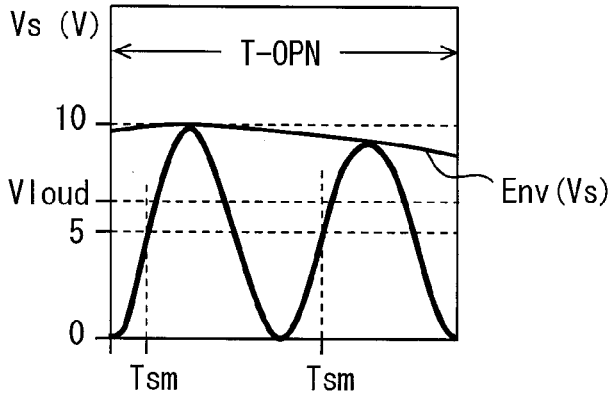
FIGS. 8A, 8B, and 8C are diagrams illustrating the waveforms of the voltages of the portions of the sound generator of FIG. 6 observed during an open-circuit period where an open-circuit occurs in the speaker.
Figure 8B:
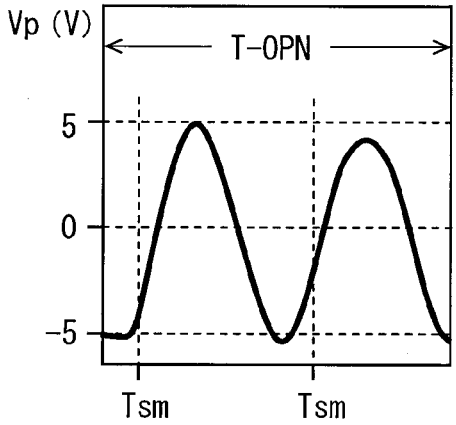
Figure 8C:
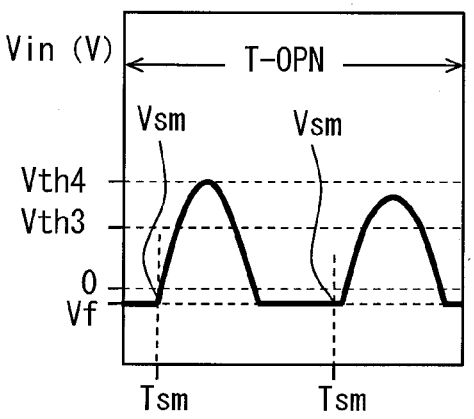

FIGS. 7A, 7B, and 7C are diagrams illustrating waveforms of voltages of portions of the sound generator 1 according to the second embodiment observed during the normal operating period T-NOR where the speaker 2 operates normally. FIGS. 8A, 8B, and 8C are diagrams illustrating the waveforms of the voltages of the portions of the sound generator 1 according to the second embodiment observed during the open-circuit period T-OPN where the open-circuit occurs in the speaker 2. Specifically, FIGS. 7A and 8A illustrate the waveform of the voltage Vs observed when the notification sound is generated. In FIGS. 7A and 8A, the sampling time Tsm, at which the voltage level of the voltage Vs becomes +5V, is shown. FIGS. 7B and 8B illustrate the waveform of the voltage Vp observed when the notification sound is generated. FIGS. 7C and 8C illustrate the waveform of the voltage Vin observed when the notification sound is generated. In FIGS. 7C and 8C, the voltage level Vsm represents the voltage Vin at the sampling time Tsm. As shown in FIG. 7C, during the normal operating period T-NOR, the voltage level Vsm is almost equal to the maximum value of the voltage Vin. In contrast, as shown in FIG. 8C, during the open-circuit period T-OPN, the voltage level Vsm is almost equal to the minimum value of the voltage Vin.

Figure 9:
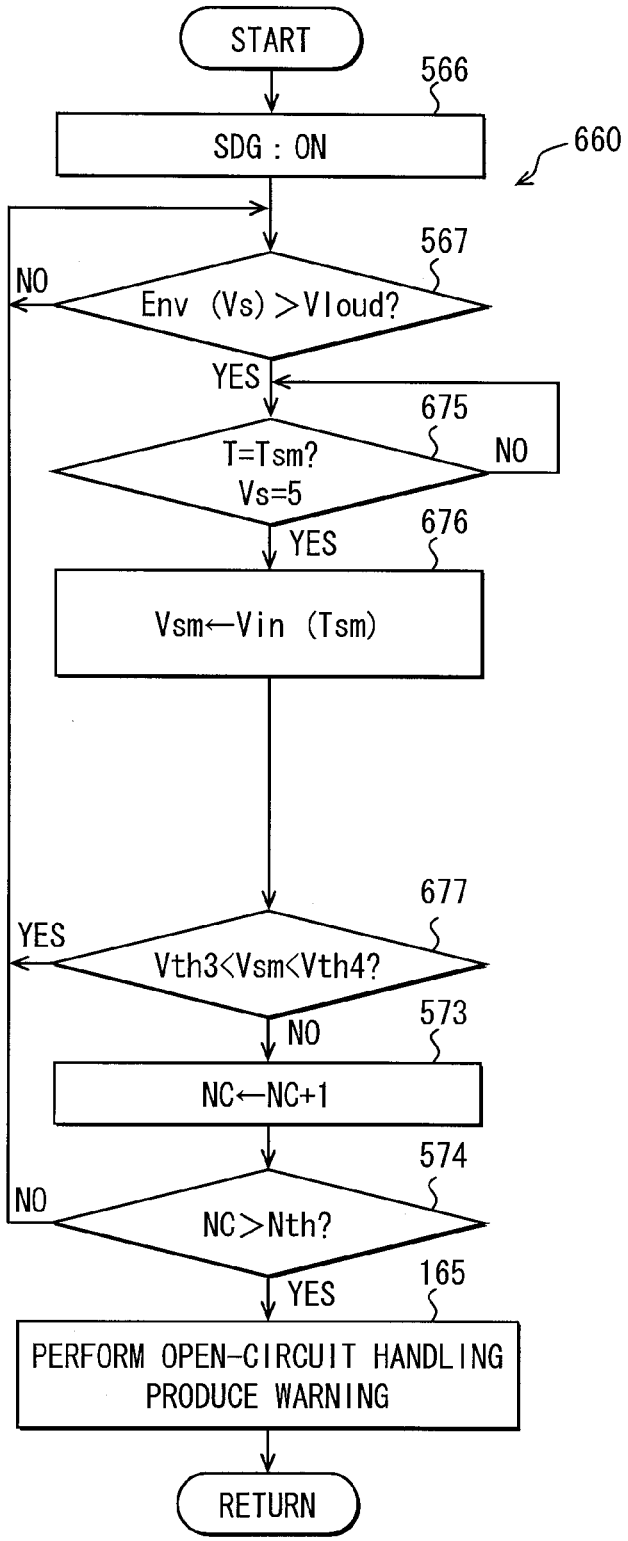
FIG. 9 is a flow chart of an open-circuit determination process performed in the sound generator of FIG. 6.

FIG. 9 is a flow chart of an open-circuit determination process 660 for implementing the open-circuit detector 642. A difference between the open-circuit determination process 560 and 660 is as follows.

At step 675, it is determined whether the present time T is the sampling time Tsm. The sampling time Tsm is a time at which the voltage Vs increases or decreases to a predetermined voltage level. Specifically, according to the second embodiment, when the voltage Vs increases to ±5V, it is determined that the present time T is the sampling time Tsm. If the voltage Vs increases to +5V corresponding to YES at step 675, the open-circuit determination process 660 proceeds to step 676, where a voltage Vin(Tsm), which is the voltage Vin at the sampling time Tsm, is stored as the voltage value Vsm. In contrast, if the voltage Vs does not increase to +5V corresponding to NO at step 675, the open-circuit determination process 660 repeats step 675. Steps 675 and 676 provide a detection section for detecting the sample value Vsm for evaluating the phase difference between the voltages Vs and Vp.

Then, the open circuit determination process 660 proceeds to step 677, where it is determined whether the voltage Vsm falls within a threshold range. Specifically, at step 677, it is determined whether the voltage Vsm is greater than a lower threshold voltage Vth3 and less than an upper threshold voltage Vth4. If the voltage Vsm falls within the threshold range corresponding to YES at step 677, the open-circuit determination process 660 returns to step 567. In contrast, if the voltage Vsm falls outside the threshold range corresponding to NO at step 677, it is determined that the open-circuit occurs in the speaker 2, and the open-circuit determination process 660 proceeds to step 573. For example, if the voltage Vsm is less than the lower threshold voltage Vth3 or greater than the upper threshold voltage Vth4, the open-circuit determination process 660 proceeds to step 573. The step 677 provides an open-circuit determination section for determining whether the open-circuit occurs in the speaker 2 based on the voltage Vsm.

As described above, according to the second embodiment, the determination section 614 determiners whether the open-circuit occurs in the speaker 2 based on the phase difference that is indicated by the voltage Vin (i.e., Vsm) detected by the detection circuit 513 when the sound signal is at the phase Tsm.

Third Embodiment

Figure 10:
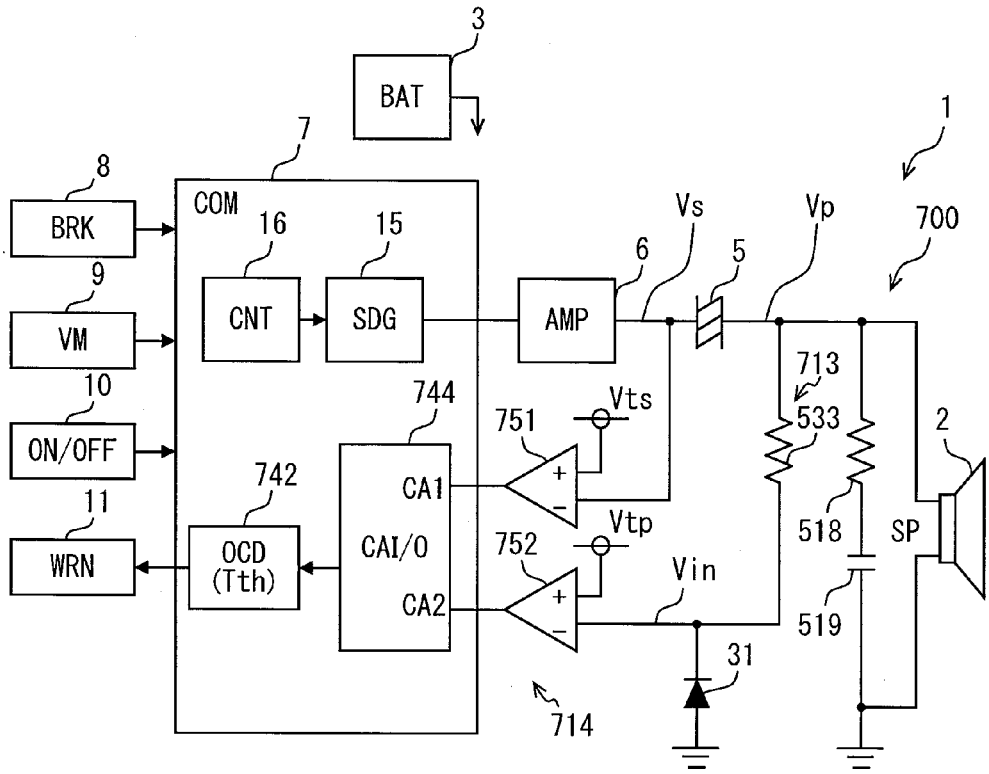
FIG. 10 is a block diagram of an operation notification sound generator including a failure detection device according to a third embodiment of the present disclosure.

FIG. 10 is a block diagram of an operation notification sound generator 1 including a failure detection device 700 according to a third embodiment of the present disclosure. A difference of the third embodiment from the preceding embodiments is as follows.

In the preceding embodiments, the determination whether or not the phase difference between the voltages Vs and Vp achieves the predetermined relationship indicating the open-circuit in the speaker 2 is performed by observing the voltage Vin at two time points T1 and T2.

In the third embodiment, whether or not the voltage Vs reaches a first voltage level is detected by hardware. Further, whether or not the voltage Vp reaches a second voltage level is detected by hardware. The controller 7 provides a process for determining whether the open-circuit occur in the speaker 2 based on a time difference between a first time when the voltage Vs reaches the first voltage level and a second time when the voltage Vp reaches the second voltage level.

The failure detection device 700 includes an operational amplifier (op-amp) 751 serving as a comparator for comparing the voltage Vs with a predetermined threshold voltage Vts. The voltage Vs is inputted to an inverting input terminal of the op-amp 751, and the threshold voltage Vts is inputted to a non-investing input terminal of the op-amp 751. The op-amp 751 outputs a high level signal or a low level signal depending on whether the voltage Vs is greater than the threshold voltage Vts. An output signal of the op-amp 751 is inputted to the controller 7.

The failure detection device 700 includes a detection circuit 713. The detection circuit 713 includes the resistor 533 and the diode 31. The diode 31 half wave rectifies the voltage Vp, thereby removing a negative voltage component of the voltage Vp. The detection circuit 713 outputs the voltage Vin.

The failure detection device 700 includes an op-amp 752 serving as a comparator for comparing the voltage Vin, i.e., the voltage Vp with a predetermined threshold voltage Vtp. The voltage Vin is inputted to an inverting input terminal of the op-amp 752, and the threshold voltage Vtp is inputted to a non-inverting input terminal of the op-amp 752. The op-amp 752 outputs a high level signal or a low level signal depending on whether the voltage Vp is greater than the threshold voltage Vtp. An output signal of the op-amp 752 is inputted to the controller 7.

The failure detection device 700 includes a determination section 714. The determination section 714 includes an input port 744 and an open-circuit detector 742. The input port 744 is an input capturing port (CAI/O). The input port 744 has a first port CA1 and a second port CA2. An output of the op-amp 751 is inputted to the first port CA1. The first port CA1 captures a time when the output of the op-amp 751 is inverted. Specifically, the first port CA1 captures a time T1 when the voltage Vs reaches the threshold voltage Vts. More specifically, the time T1 is a time when the voltage Vs increases to the threshold voltage Vts so that the output of the op-amp 751 can fall. An output of the op-amp 752 is inputted to the second port CA2. The second port CA2 captures a time when the output of the op-amp 752 is inverted. Specifically, the second port CA2 captures a time T2 when the voltage Vp reaches the threshold voltage Vtp. More specifically, the time T2 is a time when the voltage Vp increases to the threshold voltage Vtp so that the output of the op-amp 752 can fall. The input port 744 outputs the captured times T1 and T2 to the open-circuit detector 742.

The open-circuit detector 742 determines whether the open-circuit occurs in the speaker 2 by comparing the phase of the voltage Vs with the phase of the voltage Vp. Specifically, the open-circuit detector 742 determines that the open-circuit occurs in the speaker 2, when a time difference between the times T1 and T2 falls outside a predetermined threshold time range. Upon determination that the open-circuit occurs the speaker 2, the open-circuit detector 742 outputs the first activation signal for activating the warning device 11. In response to the first activation signal, the warning device 11 is activated and outputs the first alarm indicating that the open-circuit occurs in the speaker 2.

FIGS. 11A, 11B, 11C, and 11D are diagrams illustrating waveforms of voltages of portions of the sound generator 1 according to the third embodiment observed during the normal operating period T-NOR where the speaker 2 operates normally. FIGS. 12A, 12B, 12C, and 12D are diagrams illustrating the waveforms of the voltages of the portions of the sound generator 1 according to the third embodiment observed during the open-circuit period T-OPN where the open-circuit occurs in the speaker 2.

Figure 11A:
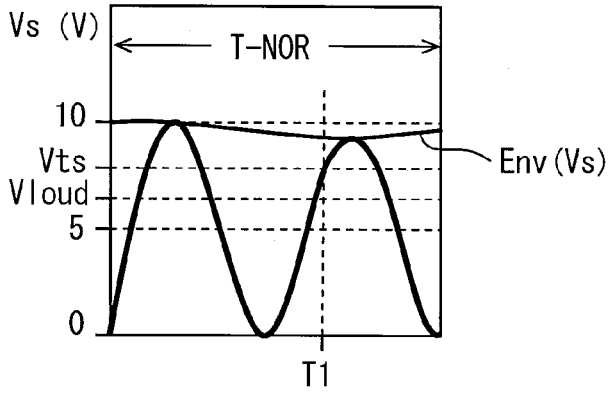
FIGS. 11A, 11B, 11C, and 11D are diagrams illustrating waveforms of voltages of portions of the sound generator of FIG. 10 observed during a normal operating period where a speaker operates normally.
Figure 11B:
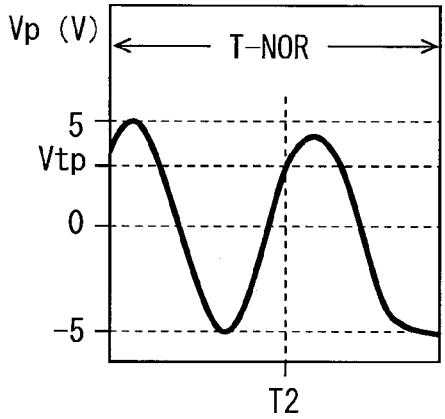
Figure 11C:
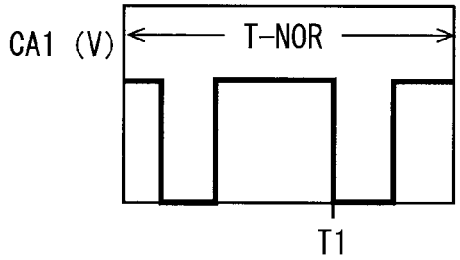
Figure 11D:
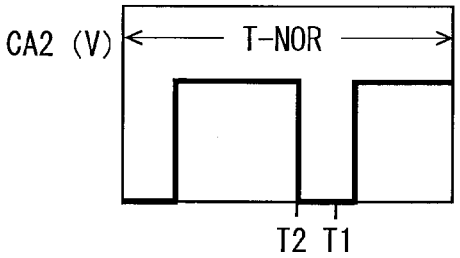
Figure 12A:
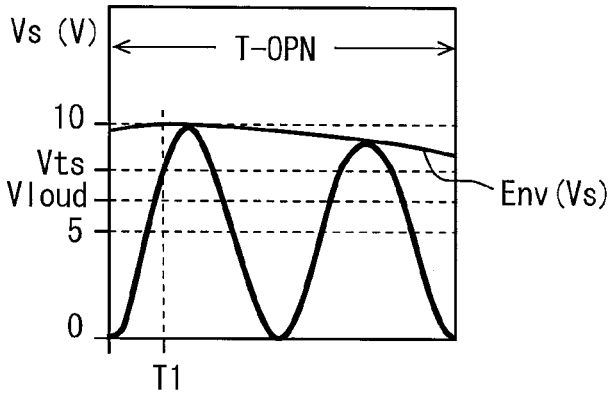
FIGS. 12A, 12B, 12C, and 12D are diagrams illustrating the waveforms of the voltages of the portions of the sound generator of FIG. 10 observed during an open-circuit period where an open-circuit occurs in the speaker.
Figure 12B:
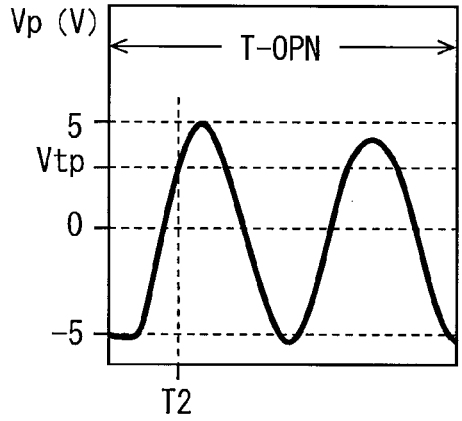
Figure 12C:
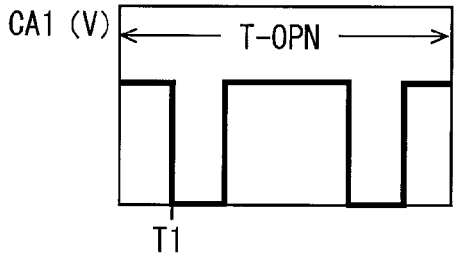
Figure 12D:
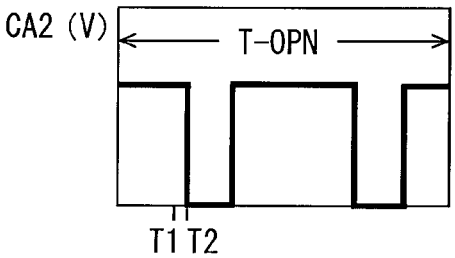

Specifically, FIGS. 11A and 12A illustrate the waveform of the voltage Vs observed when the notification sound is generated. FIGS. 11B and 12B illustrate the waveform of the voltage Vp observed when the notification sound is generated. FIGS. 11C and 12C illustrate a waveform of an input signal to the first port CA1 observed when the notification sound is generated. FIGS. 11D and 120 illustrate a waveform of an input signal to the second port CA2 observed when the notification sound is generated. As shown in FIGS. 11A-11D, during the normal operating period T-NOR, the time difference between the times T1 and T2 is large enough. Further, during the normal operating period T-NOR, the time T1 is captured before the time T2 is captured. In contrast, as shown in FIGS. 12A-12D, during the open-circuit period T-OPN, the time difference between the times T1 and T2 is zero or very small. Further, during the open-circuit period T-OPN, it is likely that the time T1 is captured at the same time as or after the time T2 is captured.

Figure 13:
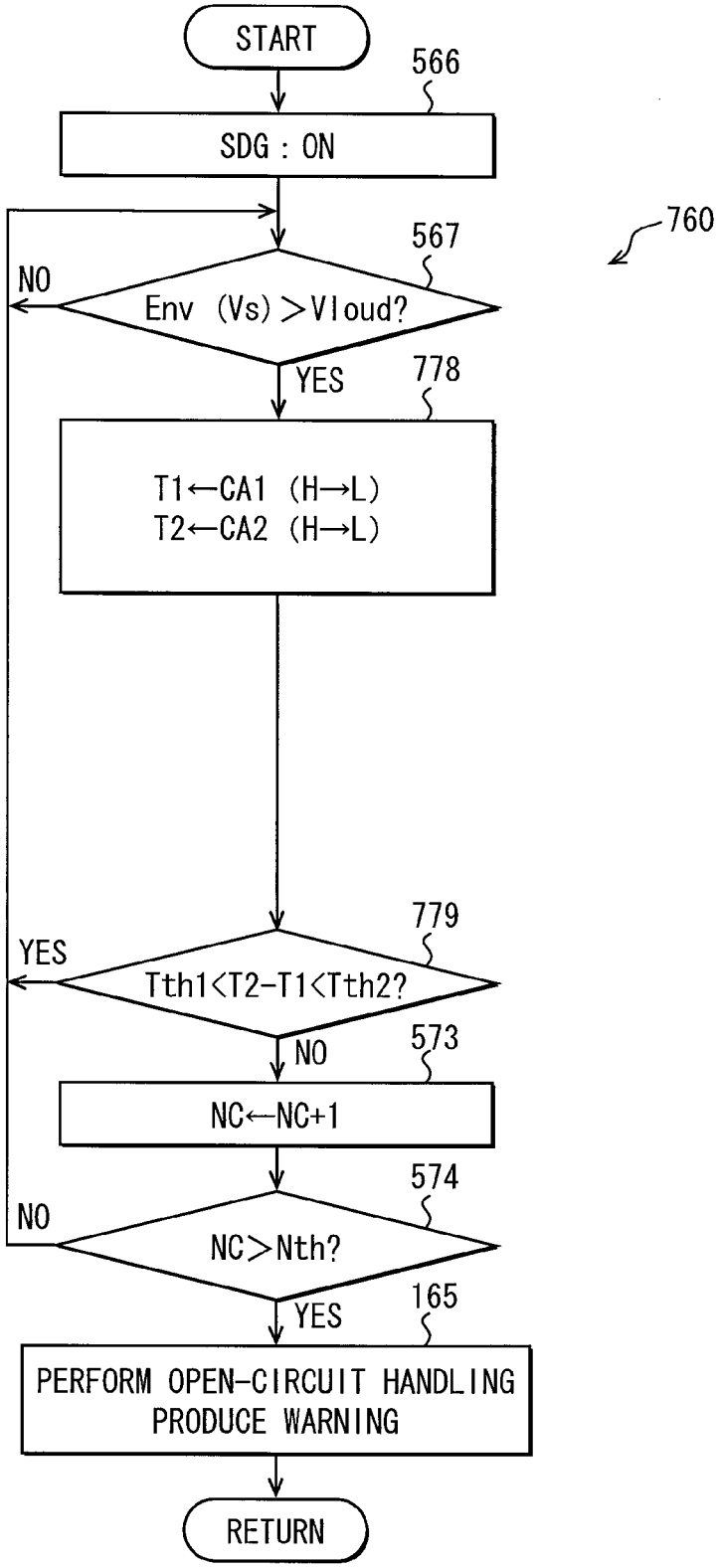
FIG. 13 is a flow chart of an open-circuit determination process performed in the sound generator of FIG. 10.

FIG. 13 is a flow chart of an open-circuit determination process 760 for implementing the open-circuit detector 742. A difference between the open-circuit determination process 560 and 760 is as follows.

At step 778, a time when an input signal to the input capturing port 744 is captured. Specifically, at step 778, a time when an input signal to the first port CA1 changes from a high level to a low level is captured as the time T1, and a time when an input signal to the second port CA2 changes from a high level to a low level is captured as the time T2. Step 778 provides a detection section for detecting the times T1 and T2 for evaluating the phase difference between the voltages Vs and Vp.

Then, the open-circuit determination process 760 proceeds to step 779, where it is determined whether a time difference T2−T1, which is calculated by subtracting the time T1 from the time T2, falls within the threshold time range. Specifically, at step 779, it is determined whether the time difference T2−T1 is greater than a lower threshold time Tth1 and less than an upper threshold time Tth2. If the time difference T2−T1 falls within the threshold time range corresponding to YES at step 779, the open-circuit determination process 760 returns to step 567. In contrast, if the time difference T2−T1 falls outside the threshold time range corresponding to NO at step 779, it is determined that the open-circuit occurs in the speaker 2, and the open-circuit determination process 760 proceeds to step 573. For example, if the time difference T2−T1 is less than the lower threshold time Tth1, the open-circuit determination process 760 proceeds to step 573. Further, if the time difference T2−T1 is greater than the upper threshold time Tth2, the open-circuit determination process 760 proceeds to step 573. Step 779 provides an open-circuit determination section for determining whether the open-circuit occurs in the speaker 2 based on the time difference between the times T1 and T2.

As described above, according to the third embodiment, the determination section 714 determines whether the open-circuit occurs in the speaker 2 based on the phase difference that is indicated by the time T1 when the sound signal reaches the voltage level Vts and the time T2 when the voltage Vin detected by the detection circuit 713 reaches the voltage level Vtp.

Fourth Embodiment

Figure 14:
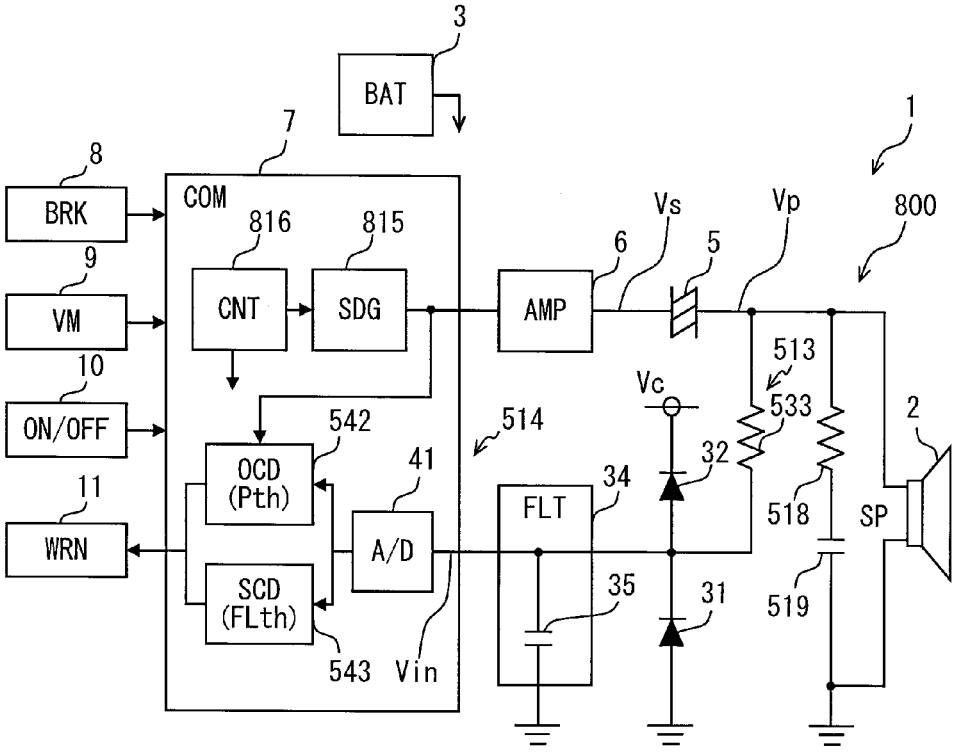
FIG. 14 is a block diagram of an operation notification sound generator including a failure detection device according to a fourth embodiment of the present disclosure.

FIG. 14 is a block diagram of an operation notification sound generator 1 including a failure detection device 800 according to a fourth embodiment of the present disclosure. A difference between the fourth embodiment from the preceding embodiment is as follows.

In the preceding embodiments, the change in the phase of the electrical signal appearing on the speaker 2 including the speaker circuit is detected by using the sound signal outputted from the sound signal generator 15, and it is determined based on the phase whether the open-circuit occurs in the speaker 2.

In the fourth embodiment, the controller 7 includes a signal generator 815 instead of the signal generator 15. The generator 815 can output not only an audible sound signal for causing the speaker 2 to output the notification sound (i.e., audible sound) but also an inaudible sound signal for causing the speaker 2 to output an inaudible sound that cannot be easily heard by people (i.e., human beings). When the notification signal is needed, a control section 816 of the controller 7 causes the sound signal generator 815 to output the audible sound signal. When the notification signal is not needed, and a test for detecting the open-circuit and/or the short-circuit in the speaker 2 is needed, the control section 816 causes the sound signal generator 815 to output the inaudible sound signal.

Figure 15:
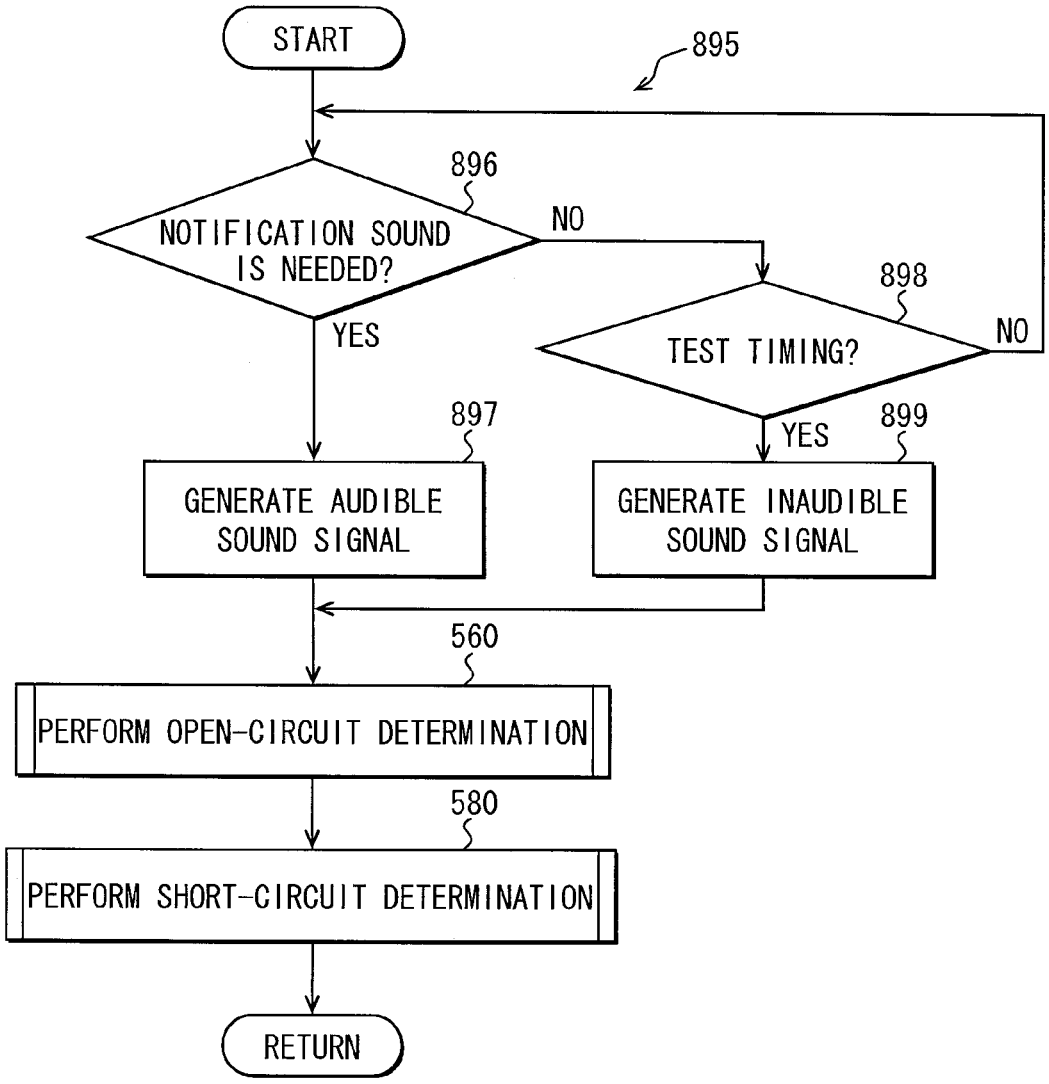
FIG. 15 is a flow chart of a control process performed in the sound generator of FIG. 14.

FIG. 15 is a flow chart of a control process 895. The control section 816 performs the control process 895, thereby controlling the signal generator 815, the open-circuit detector 542, and the short-circuit detector 543. The control process starts at step 896, where it is determined whether the notification sound is needed. For example, according to the fourth embodiment, when the speed of the vehicle falls within the low speed range, it is determined at step 896 that the notification sound is needed. If it is determined that the notification sound is needed corresponding to YES at step 896, the control process 895 proceeds to step 897.

At step 897, the sound generator 815 is caused to generate the audible sound signal for causing the speaker 2 to output the notification sound. Thus, an AC power for causing the speaker 2 to output the notification sound is supplied to the speaker 2. At this time, the phase of the voltage Vp of the speaker 2 changes depending on whether the open-circuit occurs in the speaker 2. After step 897, the open-circuit determination process 560 shown in FIG. 4 and/or the short-circuit determination process 580 shown in FIG. 5 are performed. Thus, it is determined based on the audible sound signal whether the open-circuit or the short-circuit occurs in the speaker 2.

In contrast, when the speed of the vehicle falls outside the low speed range, it is determined at step 896 that the notification sound is not needed. If it is determined that the notification sound is not needed corresponding to NO at step 896, the control process 895 proceeds to step 898. At step 898, it is determined whether the test for the speaker 2 is needed. According to the fourth embodiment, at step 898, it is determined whether a test timing of testing the speaker 2 has come. For example, it is determined at step 898 that the test timing has come, when the accumulated travel time of the vehicle reaches a predetermined value. Alternatively, the step 898 can be performed before the step 896. If the test timing has not come yet corresponding to NO at 898, the control process returns to step 896. In contrast, if the test timing has already come corresponding to YES at step 898, the control process returns to step 899. At step 899, the sound generator 815 is caused to generate the inaudible sound signal for causing the speaker 2 to output the inaudible sound. Thus, an AC power for causing the speaker 2 to output the inaudible sound is supplied to the speaker 2. At this time, although a sound that can be easily heard by people is not outputted from the speaker 2, the phase of the voltage Vp of the speaker 2 changes depending on whether the open-circuit occurs in the speaker 2. After step 899, the open-circuit determination process 560 shown in FIG. 4 and/or the short-circuit determination process 580 shown in FIG. 5 are performed. Thus, it is determined based on the inaudible sound signal whether the open-circuit or the short-circuit occurs in the speaker 2.

As described above, according to the fourth embodiment, when the notification sound is not outputted from the speaker 2, the sound generator 815 generates the inaudible sound signal for causing the speaker 2 to output the inaudible sound that cannot be easily heard by peoples. Thus, even when the notification sound is not outputted from the speaker 2, the test for detecting the open-circuit and/or the short-circuit the speaker 2 can be performed by using the inaudible sound signal.

Modifications

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, fess or only a single element, are also within the spirit and scope of the present disclosure.

In the embodiments, the sections provided by the controller 7 are implemented by software. Alternatively, the sections provided by the controller 7 can be implemented by hardware or a combination of software and hardware. For example, the controller 7 can be implemented by an analog circuit.

In the embodiments, either when the phase delay of the voltage Vin with respect to the sound signal is less than the lower thresholds Vth1, Vth3, and Tth1, or when the phase delay is greater than the upper thresholds Vth2, Vth4, and Tth2, it is determined that the open-circuit occurs in the speaker 2. Alternatively, only when the phase delay is less than the lower thresholds Vth1, Vth3, and Tth1, or only when the phase delay is greater than the upper thresholds Vth2, Vth4, and Tth2, it can be determined that the open-circuit occurs in the speaker 2.

In the embodiments, it is determined whether each of the open-circuit and the short-circuit occurs in the speaker 2. Alternatively, it can be determined whether only one of the open-circuit and the short-circuit occurs in the speaker 2.

In the embodiments, when the change Vflc in the voltage Vp decreases below the threshold change value FLth, the short-circuit detector 543 determines that the short-circuit occurs in the speaker 2. Alternatively, when the voltage Vp remains unchanged at almost zero volt for a predetermined time period, the short-circuit detector 543 can determine that the short-circuit occurs in the speaker 2.

In the embodiments, the controller 7 outputs the activation signal directly to the warning device 11. That is, the controller 7 directly performs a failure handing such as the open-circuit handling or the short-circuit handling. Alternatively, the controller 7 can output a handling signal to another device, and the other device can perform the failure handing.

What is claimed is:

1. A failure detection device for a speaker mounted on a vehicle, the failure detection device comprising:

a signal generator configured to generate a sound signal corresponding to a sound outputted from the speaker;

an amplifier configured to amplify the sound signal generated by the signal generator;

a coupling capacitor configured to supply the sound signal amplified by the amplifier to the speaker;

a detection circuit configured to directly or indirectly detect a terminal voltage on a terminal of the speaker; and a determination section configured to determine whether an open-circuit occurs in the speaker based on a phase difference between a phase of the sound signal and a phase of the terminal voltage, wherein the terminal of the speaker is coupled to the coupling capacitor.

2. The failure detection device according to claim 1, wherein the determination section determines that the open-circuit occurs in the speaker, when the phase of the sound signal and the phase of the terminal voltage achieve a predetermined relationship.

3. The failure detection device according to claim 2 wherein the determination section determines that the open-circuit occurs in the speaker, when the predetermined relationship continues for a predetermined time period.

4. The failure detection device according to claim 1 wherein the determination section determines that the open-circuit occurs in the speaker, when a delay of the phase of the terminal voltage from the phase of the sound signal decreases below a predetermined threshold value.

5. The failure detection device according to claim 1, wherein the determination section determines that the open-circuit occurs in the speaker, when a delay of the phase of the terminal voltage from the phase of the sound signal increases above a predetermined threshold value.

6. The failure detection device according to claim 1, wherein the phase difference is calculated from a first voltage and a second voltage, the first voltage is the terminal voltage detected by the detection circuit when the sound signal is at a first phase, and the second voltage is the terminal voltage detected by the detection circuit when the terminal voltage is at a second phase.

7. The failure detection device according to claim 1, wherein the phase difference is calculated from a first voltage, and the first voltage is the terminal voltage detected by the detection circuit when the sound signal is at a first phase.

8. The failure detection device according to claim 1, wherein the phase difference is calculated from a first time and a second time, the first time is when the sound signal reaches a first voltage value, and the second time is when the terminal voltage reaches a second voltage value.

9. The failure detection device according to claim 1, wherein the determination section determines that the open-circuit occurs in the speaker, when a volume indicated by the sound signal increases above a predetermined volume value.

10. The failure detection device according to claim 1, wherein the sound signal includes an audible sound signal that causes the speaker to output an audible operation notification sound for notifying that the vehicle is in an operating state.

11. The failure detection device according to claim 10, wherein the sound signal includes an inaudible sound signal that causes the speaker to output an inaudible sound, and the signal generator outputs the inaudible sound signal when the signal generator does not output the audible sound signal.

12. The failure detection device according to claim 1, wherein the determination section determines that a short-circuit occurs in the speaker, when a change in the terminal voltage decreases below a predetermined change value.

* * * * *